US007062191B2

(12) United States Patent
Matsukura

(10) Patent No.: US 7,062,191 B2
(45) Date of Patent: Jun. 13, 2006

(54) IMAGE FORMING DEVICE INCLUDING AC LOADS DRIVEN BY AN AC POWER SUPPLY

(75) Inventor: Takashi Matsukura, Ibaraki (JP)

(73) Assignee: Canon Finetech Inc., Ibaraki (JP)

( * ) Notice: Subject to any disclaimer, the term of this patent is extended or adjusted under 35 U.S.C. 154(b) by 115 days.

(21) Appl. No.: 10/742,620

(22) Filed: Dec. 18, 2003

(65) Prior Publication Data

US 2005/0063725 A1 Mar. 24, 2005

(30) Foreign Application Priority Data

Dec. 20, 2002 (JP) ..... 2002-370919

(51) Int. Cl.
*G03G 15/00* (2006.01)
*G03G 15/20* (2006.01)
*G03G 21/00* (2006.01)

(52) U.S. Cl. ..... 399/88; 399/37

(58) Field of Classification Search ..... 399/88, 399/75, 33, 37; 347/50
See application file for complete search history.

(56) References Cited

U.S. PATENT DOCUMENTS 5,905,899 A 5/1999 Kim et al. ..... 713/300
6,804,482 B1 * 10/2004 Kim et al. ..... 399/88
6,909,616 B1 * 6/2005 Kim ..... 363/16
2002/0171694 A1 * 11/2002 Takayanagi ..... 347/5

FOREIGN PATENT DOCUMENTS

| | | | |
|---|---|---|---|
| CN | 1171645 A | | 1/1998 |
| CN | 1319941 A | | 10/2001 |
| JP | 2001-147747 A | * | 5/2001 |
| JP | 2001-211274 | | 8/2001 |
| JP | 2001-218281 A | | 8/2001 |
| JP | 2002-007003 A | * | 1/2002 |
| JP | 2003-118204 | | 4/2003 |

* cited by examiner

*Primary Examiner*—Sophia S. Chen
(74) *Attorney, Agent, or Firm*—Dellett & Walters

(57) ABSTRACT

A printer (image forming device) (10), which includes AC loads driven by an AC power, is connected to an external device (30) via a single power line for a logic operation and a signal line. More specifically, a printer driver (11) and an engine controller (13) operate on a 5V power supply voltage obtained via a USB cable (20). When a standby state is entered, a relay (17) is turned off, an AC power supply to a drive power supply (19) is disconnected, and a power supply to the AC loads is disconnected. When the standby state is released by a signal received from the PC (30), an ON signal is generated for the relay (17) to supply the AC power. In this way, the standby power is reduced to improve energy saving.

7 Claims, 5 Drawing Sheets

IMAGE FORMING DEVICE INCLUDING AC LOADS DRIVEN BY AN AC POWER SUPPLY

DETAILED DESCRIPTION

1. Field of the Invention

The present invention relates to an image forming device, such as a printer, that has a serial communication interface as an external terminal for receiving signals from an external device, for example, a USB (Universal Serial Bus) used for connection to an external device such as a PC (Personal Computer).

2. Related Art

Conventionally, an image forming device typically has connection terminals, such as a Centronics parallel interface terminal, USB terminal, or network LAN terminal, as terminals for connection to a PC. Increasingly, more and more low-cost image forming devices with only an easy-to-connect USB terminal are used.

An image scanner, typically only with a USB terminal as the connection terminal for connection to a PC, sometimes does not have a power supply in the scanner but receives power from the PC via the connected USB terminal for operation.

The power supplied to a device via the USB power line is normally +5V, and the device operates in one of the following consumption modes:

(1) Consumption mode at maximum current of 100 mA or lower (2) Consumption mode at maximum current of 500 mA or lower (3) Suspend consumption mode at maximum current of 500 μA or lower The mode (1) given above is the basic USB current consumption mode in which a device can consume the maximum current of 100 mA from the bus when the device gets connected to the USB for the first time. Even a USB device that consumes 100 mA or higher during normal operation must use this consumption mode and keep the consumption current at 100 mA or lower until an instruction is received from the PC.

The mode (2) given above is a mode not used by all devices but required only by a device that consumes a 100 mA or higher current from the bus for normal operation. This consumption mode becomes effective only when the PC permits the use of this consumption mode after the device configuration information is reported to a PC (the PC recognizes the device and the device becomes available for use).

The mode (3) given above is a mode all USB devices must support. When a PC does not perform bus activity for at least a predetermined time (for example, 3 mS) for example, because the PC enters a sleeping state (suspend), a USB device automatically detects this condition and enters the suspend consumption mode.

However, an image forming device (for example, printer), which has only a USB terminal as an external terminal for receiving external signals, usually consumes power exceeding the voltage of +5V and the maximum current of 500 mA supplied from the USB. Therefore, such a device does not usually receive power from the USB but has a dedicated power supply, such as a built-in power supply or an AC adapter, to operate the whole device.

The outline configuration of a printer 100 having only a USB interface for connection to an external device such as a PC 30 will be described with reference to FIG. 1. The outline operation of the printer 100 is that a power switch 118 in an alternate current (AC) receiving unit 25 is turned on to activate a drive power supply 119, which generates a logic power supply voltage (5V, 3.3V, etc.) required for the device and a higher drive power supply voltage (24V, etc.). When the power switch 118 is turned on, the logic power (5V, 3.3V, etc.) is supplied to a printer driver 111, an engine controller 113, and so on, to perform the initial operation and the printer enters a standby state. In the standby state, the standby power is consumed including that for the logic power required for the printer driver 111 and the engine controller 113 as well as for the drive power required for driving loads (not required at the standby time).

When an operation instruction (for example, print operation) is sent from an external device to the printer via a USB cable 20, the external device, printer driver 111, and engine controller 113 communicate each other and the engine controller 113 controls the loads (motor, solenoid, high voltage unit, etc.) in the device to execute the print operation. At this time, the engine controller 113 also turns on a relay control signal 115 and turns on a safety relay 117, which is the primary-side relay, to supply power to the AC loads (for example, fixing heater) required in the image forming device.

Actual on/off control of the AC load is performed by a triac (not shown), provided between the safety relay 117 and the AC loads, after the safety relay 117 is turned on. The primary purpose of this safety relay 117, essential to the image forming device, is that, when a paper jam condition (paper jam) (first abnormality) or a heater temperature control abnormality (second abnormality) occurs in the device, the relay control signal from the engine controller 113 (or relay control signal from the heater abnormality detection circuit) forcibly turns off the safety relay 117 to disconnect the power to the AC loads.

In the printer 100, the 5V power supplied from the USB is not used as the operating power.

Today, cost reduction is most important in designing a small, low-cost image forming device and, to accomplish it, the simplification of the power supply circuit is effective. However, the configuration of the power supply circuit with multiple outputs, such as a low-voltage logic power (5V, 3.3V, etc.) and a higher voltage load drive power (24V, etc.), is too complex to reduce the cost.

Recently, energy saving is required for a device and, in particular, power saving is required in the standby state in which the device is not performing operation (print operation). The need to keep the device always in the standby state to allow the user to immediately use the device any time he or she wants results in the wasteful consumption of the standby power, producing a problem to energy saving. An image forming device, which is used only when an external device such as a PC is used, requires the power switch 118 that turns on or off the power to the image forming device to reduce the standby power when the external device is not used.

In view of the foregoing, it is an object of the present invention to reduce the standby power and thereby to further save energy in an image forming device that has AC-power driven AC loads and is connected to an external device via a logic power line and a signal line.

It is another object of the present invention to simplify the configuration of a power supply circuit, which controls and operates the device, to reduce the cost.

It is still another object of the present invention to improve the operability of the image forming device during operation time.

SUMMARY OF THE INVENTION

An image forming device according to the present invention is an image forming device that includes AC loads driven by an AC power supply and comprises a connection terminal for connection to an external device via a cable including a power line for a single power supply voltage and a signal line; an AC power receiving terminal via which an AC power to be supplied to the AC loads is received; a drive power supply that generates a DC power supply voltage, which is higher than the single power supply voltage, from the AC power; switching means connected between the AC power receiving terminal and the drive power supply; and control means for controlling device operation using the single power supply voltage, received from the external device, as an internal logic power supply. When a standby state is entered while the single power supply voltage is received from the external device, the control means generates an OFF signal for the switching means to disconnect an input of the AC power to the drive power supply and, when the standby state is released by a signal received from the external device, generates an ON signal for the switching means to receive the AC power to the drive power supply.

This configuration disconnects the input of the AC power to the drive power supply when the image forming device is in the standby state and therefore reduces the standby power. In addition, the power switch used to turn on or off the input of AC power through user operation can be eliminated. As a result, the configuration of the power supply circuit is simplified and the cost can be reduced. Simply connecting the cable to the image forming device makes the image forming device available for use, thus increasing operability.

When the single power supply voltage is received from the external device, the control means generates the ON signal for the switching means for a predetermined time to perform a predetermined initial operation. This makes it possible to perform initial operation, during which the drive power supply requires the drive power, upon receipt of the single power supply voltage from the external device.

The switching means comprises a safety relay that is provided in the image forming device and that disconnects the input of the AC power to ensure safety based on a predetermined cause. This allows a single switching means to be used as the power disconnection switch used when an abnormality occurs in the image forming device and the power disconnection switch used during the standby state.

For example, the AC power to the AC loads is derived from a stage following the switching means and, when a predetermined abnormality is detected, the control means generates the OFF signal for the switching means to disconnect the supply of the AC power to the AC loads. The predetermined abnormality is a generation of a paper jam or a temperature control abnormality in a fixing heater.

According to the present invention, a power switch for turning on or off the input of the AC power through user operation is eliminated. In addition, the present invention eliminates the need for the image forming device body to have a power supply that supplies power at the same voltage as single power supply voltage supplied from the external device.

DESCRIPTION OF THE PREFERRED EMBODIMENT

A preferred embodiment of an image forming device according to the present invention will be described raising a printer as an example.

Figure 2:
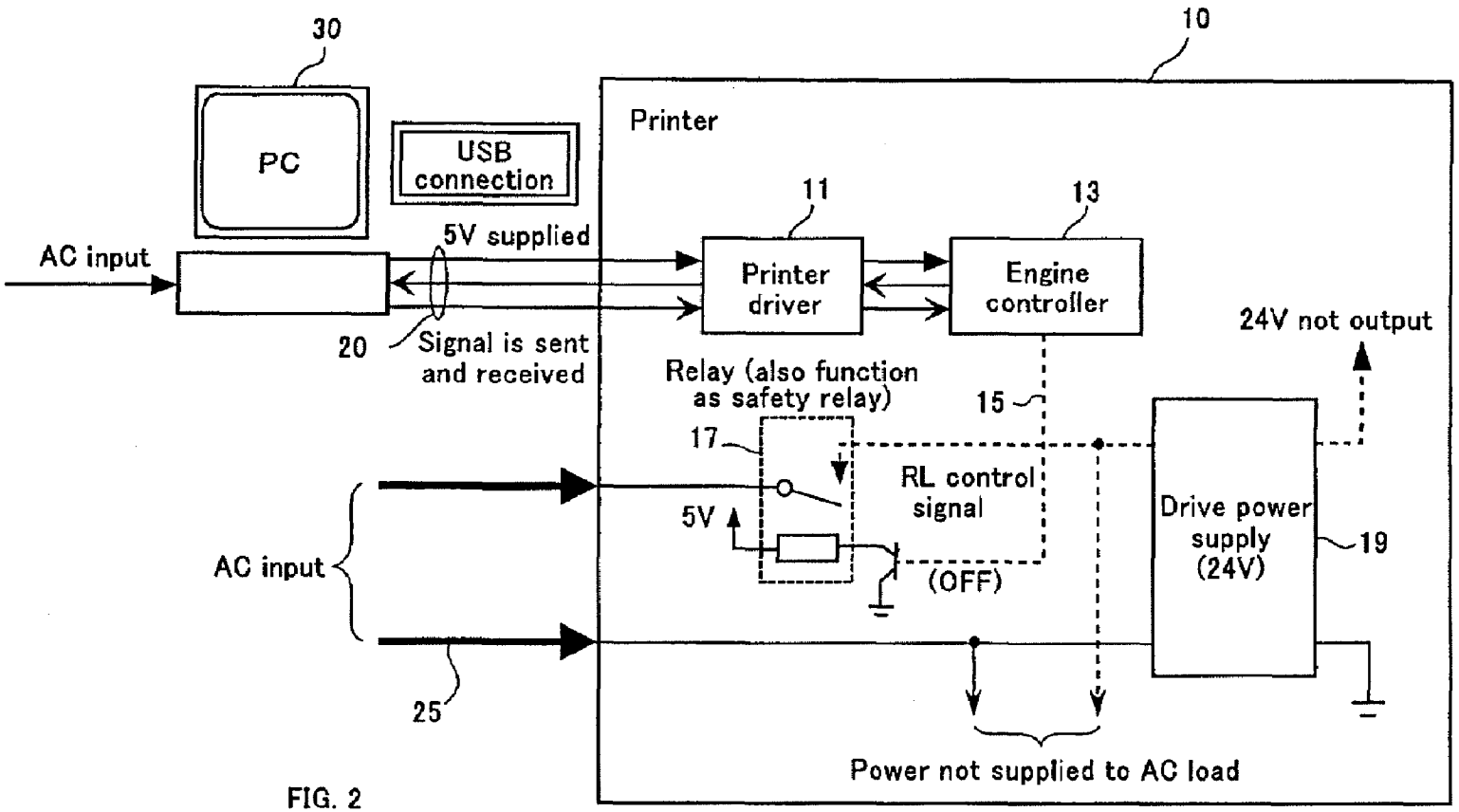
FIG. 2 is a configuration diagram showing the standby-time operation state of a printer in an embodiment of the present invention.
Figure 3:
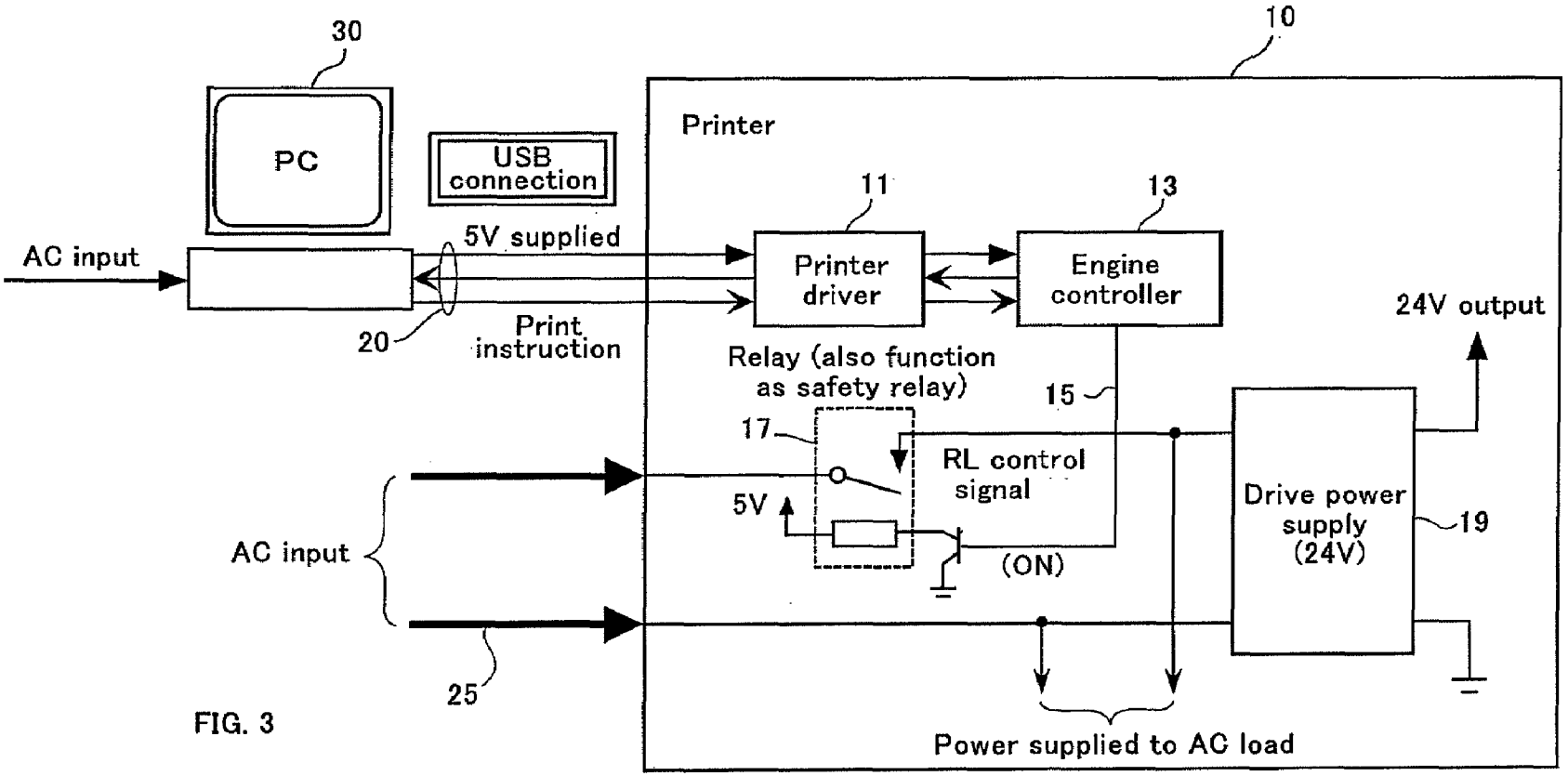
FIG. 3 is a configuration diagram showing the print-time operation state of the printer in the embodiment of the present invention.

FIG. 2 and FIG. 3 are configuration diagrams showing the operation state of a printer in the embodiment at standby time and print time, respectively.

A printer 10 has only a USB interface as an interface for connection to a PC 30 that is an external device. The printer 10 comprises a printer driver 11 that operates only on the 5V power supplied from the PC 30 via a USB cable 20; an engine controller (control means) 13 connected to the printer driver 11 to receive the 5V power for operation; an AC receiving unit 25; a primary relay 17 that receives the AC power from the AC receiving unit 25 and operates on the logic power supply voltage (5V); a drive power supply (24V, etc.) 19 that can supply power when the primary relay 17 is turned on; and AC loads (for example, fixing heater) not shown. The AC power to the AC loads is derived from the stage following the primary relay 17.

Before using the printer 10, the user connects the printer 10 to the PC 30 via the USB cable 20 and starts the PC (or connects the printer to the PC already in operation). This allows the printer to receive the 5V power from the PC 30 via the power line included in the cable 20. The received 5V power is transformed to another logic power voltage (for example, 3.3V) as necessary for use in the printer and is supplied to the printer driver 11, engine controller 13, sensor (not shown), and so on in the printer 10.

The printer driver 11 and the engine controller 13 start operation on the 5V power supplied from the PC 30 and perform communication between the PC 30 and the printer 10. This allows the PC 30 and the printer 10 to identify that they are connected with each other. The printer performs necessary initial operation and enters the standby state.

Because the DC loads (motor, solenoid, high voltage unit, etc.) and the AC loads (fixing heater, etc.) need not be driven in the standby state, the relay (RL) control signal 15 from the engine controller 13 is turned off to disconnect the power supplied to the drive power supply (24V, etc.) 19 and the AC loads in the printer. Therefore, no wasteful standby power, except the power the 5V power from the PC 30, is consumed. That is, the printer body does not use power at all during standby time.

Actually, however, immediately after the power switch is turned on, the initial operation is performed to put the DC loads (motor, heater, etc.) into test operation to allow the printer to start operation immediately. During that predetermined period, the drive power (24V, etc.) is used temporarily. After the operation is terminated completely, the printer enters the standby state in which the printer operates only on the logic power.

Figure 1:
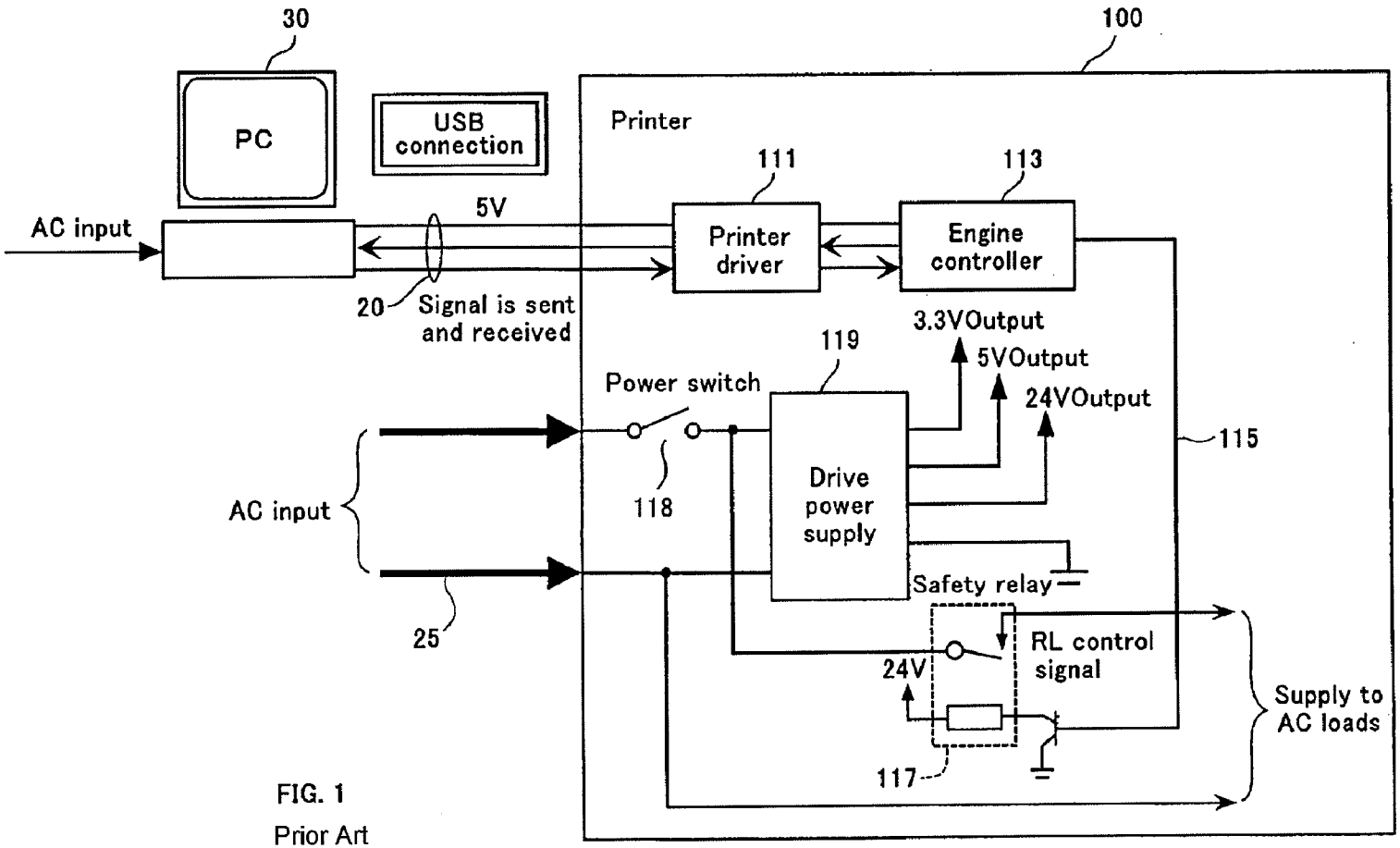
FIG. 1 Prior Art
FIG. 1 is a block diagram showing the general configuration of a conventional printer having only the USB interface for connection to an external device.

This printer neither starts operation nor consumes power unless the condition that the printer is connected to the PC 30 and the PC 30 is in operation is satisfied. Therefore, the power switch (118 in FIG. 1) of the printer is not necessary.

Next, with reference to FIG. 3, the operation of the printer 10 at operation time (for example, operation at print time) will be outlined.

When an operation instruction (for example, a print operation) is sent from the PC 30 to the printer 10 via the USB cable 20 in the standby state state. 2, the printer driver 11 and the engine controller 13 communicate each other and the engine controller 13 turns on the relay control signal 15 to turn on the primary relay 17. Turning on this relay supplies power to the drive power supply (24V, etc.) and the AC loads (for example, fixing heater) in the printer 10 to enable the printer to start a print operation.

Like the conventional printer, the actual on/off control of the AC loads (for example, fixing heater) is performed by a triac (not shown), provided between the primary relay 17 and the AC loads, after the primary relay 17 is turned on.

When a paper jam condition (paper jam) or a heater temperature control abnormality occurs in the printer, the primary relay 17 is turned off by the relay control signal from the engine controller 13 or by the relay control signal from the heater abnormality detection circuit. This means that the primary relay 17 can function also as the safety circuit relay that forcibly disconnects power to the AC loads.

Not only the primary relay 17 of the printer 10 according to the present invention can disconnect power to the AC loads but also, when an abnormal current such as a load drive power short-circuit condition is detected, the primary relay 17 can disconnect power supplied from the drive power supply.

The primary relay 17, conventionally driven by the drive power supply (24V, etc.) in most cases, is driven by the logic power voltage (5V in this example) in the printer according to the present invention because the drive power supply cannot be used in the standby state.

Figure 4:
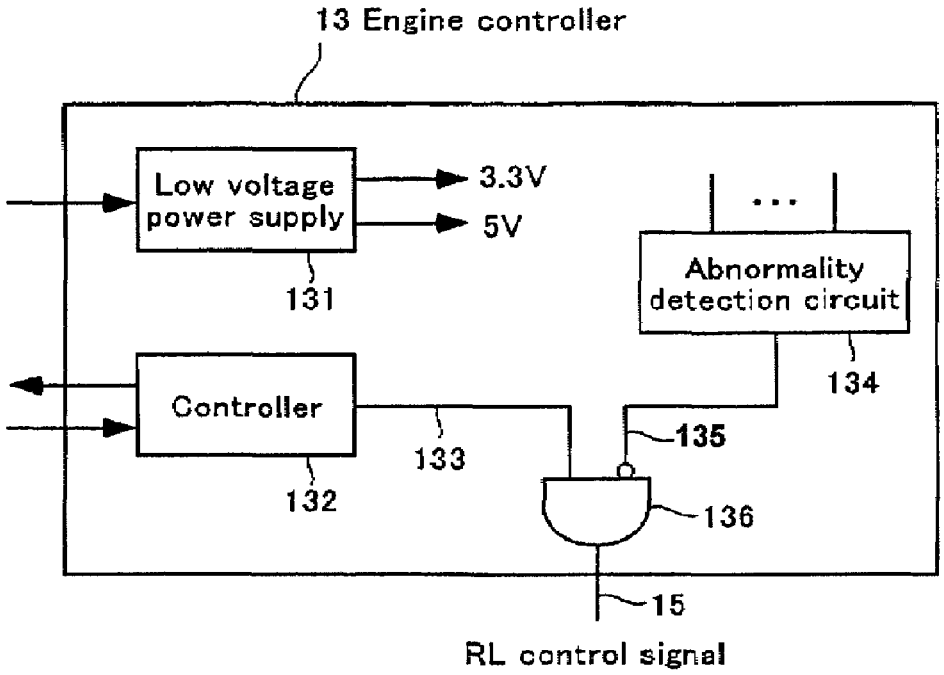
FIG. 4 is a block diagram showing the configuration of the main part of an engine controller in the embodiment of the present invention.

FIG. 4 shows the configuration of the main part of the engine controller 13 in this embodiment. The engine controller 13 comprises a low voltage power supply 131, a controller 132, an abnormality detection circuit 134, and a logical product gate 136. The low voltage power supply 131 generates a necessary low DC voltage (for example, 3.3V) from the voltage of 5V received from the PC 30 via the USB cable 20. The controller 132, which controls the operation of the engine controller 13, generates an output signal 133 under a predetermined condition to control the on/off state of the relay control signal 15. The controller 132 turns on the output signal 133 at a print operation time and, based on the output from a paper sensor not shown, turns off the output signal 133 upon detection of a paper jam condition in the printer (paper jam). The abnormality detection circuit 134 detects a heater temperature control abnormality, based on the output of a temperature sensor, not shown, provided for sensing the heater temperature of the fixing unit and, when such an abnormality is generated, sets an abnormality detection signal 135 high. The output signal 133 and the abnormality detection signal 135 are sent to the logical product gate 136 and the resulting logical product output becomes the relay control signal (RL control signal) 15. The relay control signal 15 becomes a high-level (relay on) signal when the output signal 133 is high and the abnormality detection signal 135 is low.

The low voltage power supply 131 may also be provided in the printer driver 11. When a low voltage other than 5V is not necessary, the low voltage power supply 131 may be eliminated.

Figure 5:
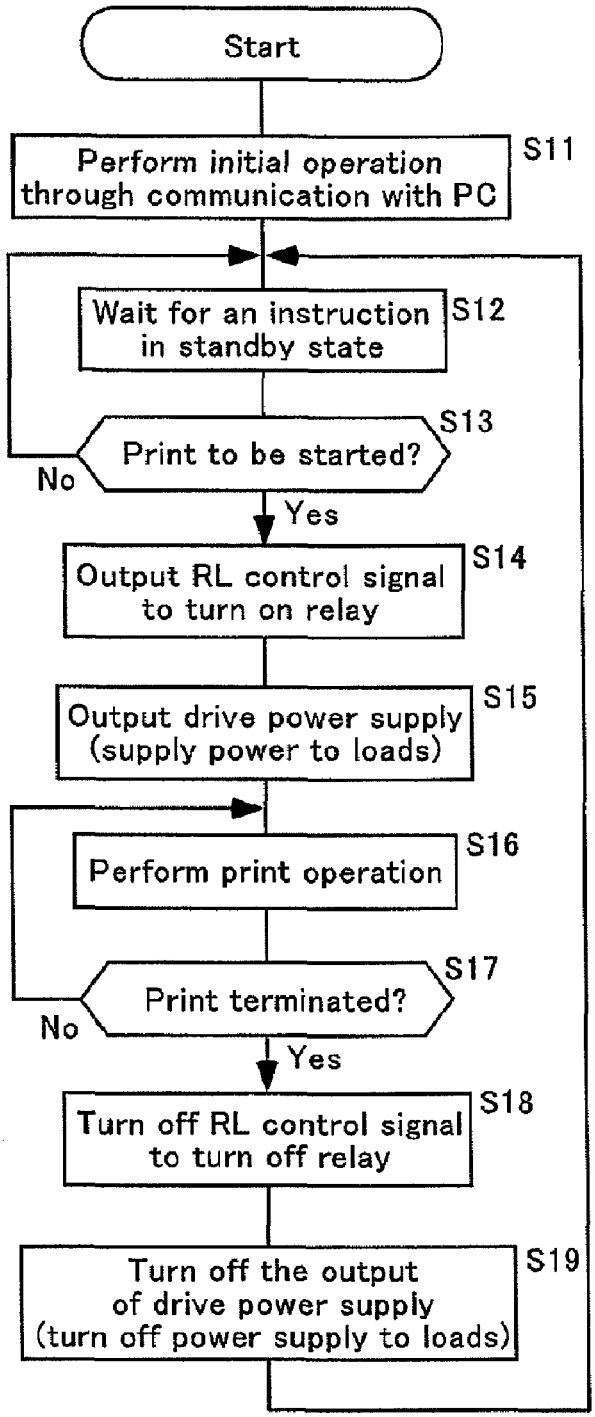
FIG. 5 is a flowchart showing a sequence of control flow in the embodiment of the present invention.

FIG. 5 is a flowchart showing a sequence of control flow in this embodiment.

When the PC 30 is started with USB connected to the printer 10, the voltage of 5V is supplied to the printer 10 via the USB cable 20. At this time, the printer performs initial operation while communicating with the PC 30 (S11) and enters the standby state to wait for an instruction (S12). In response to a print instruction from the PC 30 (S13, Yes), the primary relay 17 of the AC power supply is turned on by the logic power supply voltage (S14) to make the drive power (24V, etc.) available for use (S15) and the print operation is performed (S16). When the print operation is terminated (S17, Yes), the RL control signal 15 is turned off to turn off the relay 17 (S18) so that the output of the drive power supply is disconnected (S19). After that, the printer returns to the standby state (S13) to wait for the next print instruction.

To meet the energy saving requirements, the printer in this embodiment, which has no power switch, reduces the standby power to 0 W when the PC is not turned on, and requires only the minimum logic power consumption current (5V, 500 mA or less) when the printer is used.

For a printer with a heat fixing unit, it is desirable that a fixing system be used in which the fixing heat is reached quickly after the start of drive power supply output (for example, the SURF (Surface Rapid Fusing) fixing system).

Although a preferred embodiment of the present invention has been described, it will be understood that various modifications and changes may be made without departing from the scope of the invention. For example, although USB is described as an example in this embodiment, the present invention may also be applied to another interface (for example, IEEE 1394) in which a cable is used that has a low-voltage power supply line as well as a signal line.

When the image forming device according to the present invention, which includes AC loads driven by the AC power supply and which is connected to an external unit with a single logic power line and a signal line, enters the standby state with the single power supply voltage supplied from the external unit, the input from the AC power supply to the drive power supply is disconnected. When a signal is received from the external unit and the standby state of the image forming device is released, the AC power is input to the drive power supply. This configuration reduces the standby power and simplifies the power supply circuit for controlling and operating the device, making it possible to further reduce the cost. Using the existing safety relay in the device also as the AC power supply disconnection switch reduces the cost of the device.

The invention claimed is:

1. An image forming device including AC (Alternate Current) loads driven by an AC power supply, comprising:

a connection terminal for connection to an external device via a cable including a power line for a single power supply voltage and a signal line;

an AC power receiving terminal via which an AC power to be supplied to the AC loads is received;

a drive power supply that generates a DC (Direct Current) power supply voltage, which is higher than the single power supply voltage, from the AC power;

switching means connected between said AC power receiving terminal and said drive power supply; and control means for controlling device operation using the single power supply voltage, received from the external device, as an internal logic power supply;

wherein, when a standby state is entered while the single power supply voltage is received from the external device, said control means generates an OFF signal for said switching means to disconnect an input of the AC power to said drive power supply and, when the standby state is released by a signal received from the external device, generates an ON signal for said switching means to apply the AC power to said drive power supply.

2. The image forming device according to claim 1 wherein, when the single power supply voltage is received from the external device, said control means generates the ON signal for said switching means for a predetermined time to perform a predetermined initial operation.

3. The image forming device according to claim 1 wherein said switching means comprises a safety relay that is provided in said image forming device and that disconnects the input of the AC power to ensure safety based on a predetermined cause.

4. The image forming device according to claim 3 wherein there is no power switch provided for turning on or off the input of the AC power through a user operation.

5. The image forming device according to claim 1 or 3 wherein the AC power to said AC loads is derived from a stage following said switching means and wherein, when a predetermined abnormality is detected, said control means generates the OFF signal for said switching means to disconnect a supply of the AC power to said AC loads.

6. The image forming device according to claim 5 wherein the predetermined abnormality is a generation of a paper jam.

7. The image forming device according to claim 5 wherein the predetermined abnormality is a temperature control abnormality in a fixing heater.

* * * * *